United States Patent [19]

Georges

[11] Patent Number: 4,708,325

[45] Date of Patent: Nov. 24, 1987

[54] INDUCTION HEATING SYSTEM FOR REHEATING THE EDGES OF A METALLURGICAL PRODUCT AND VARIABLE AIR GAP INDUCTOR ASSOCIATED THEREWITH

[75] Inventor: Philippe Georges, Terville, France

[73] Assignee: Institut de Recherches de la Siderurgie Francaise—IRSID, Maizieres-les-Metz, France

[21] Appl. No.: 867,503

[22] Filed: May 28, 1986

[30] Foreign Application Priority Data

Jun. 7, 1985 [FR] France ..... 85 08684

[51] Int. Cl.[4] ..... H05B 5/00; C21D 9/52

[52] U.S. Cl. ..... 266/90; 219/10.61 R; 219/10.79; 266/104; 266/129

[58] Field of Search ..... 266/104, 90, 129; 219/10.43, 10.61, 10.79

[56] References Cited

U.S. PATENT DOCUMENTS

| | | | |
|---|---|---|---|
| 1,996,502 | 4/1935 | Brown | 219/17 |
| 2,010,622 | 8/1935 | Brown | 219/47 |
| 2,492,187 | 12/1949 | Rusca | 219/10.61 |
| 3,313,907 | 4/1967 | Geisel et al. | 219/10.61 |
| 3,692,969 | 9/1972 | Kasper | 219/10.57 |
| 4,405,386 | 9/1983 | Mravic et al. | 148/11.8 A |

FOREIGN PATENT DOCUMENTS

| | | | |
|---|---|---|---|
| 0038655 | 10/1981 | European Pat. Off. . | |
| 1402457 | 5/1965 | France . | |
| 2466306 | 9/1980 | France . | |
| 2555353 | 5/1985 | France . | |
| 485651 | 9/1938 | United Kingdom | 266/129 |

*Primary Examiner*—Christopher W. Brody
*Attorney, Agent, or Firm*—Staas & Halsey

[57] ABSTRACT

The device for inductively reheating the verges of a metallurgical product moving down a production line comprises wound pole inductors with C-shaped magnetic yokes, arranged laterally straddling the path followed by the verges. The two arms of the C are trunnioned to open to a greater or lesser extent, providing a variable air gap, controlled by a cylinder.

9 Claims, 6 Drawing Figures

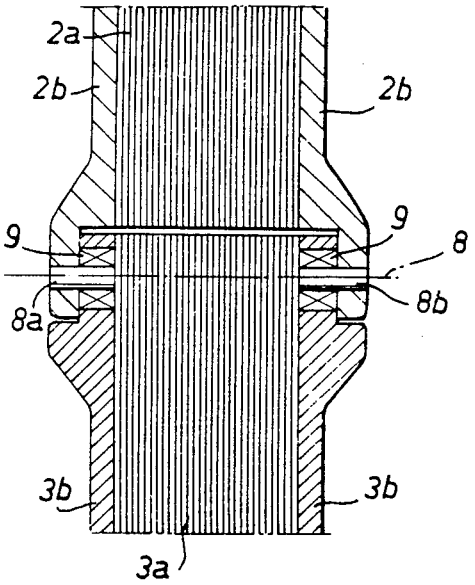
Fig. 4
Fig. 5A
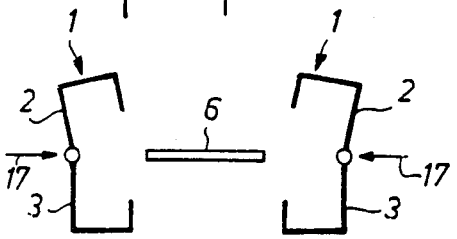
Fig. 5B
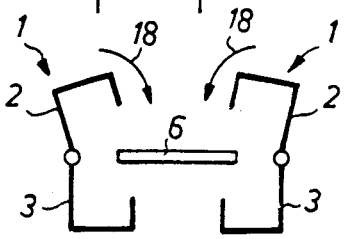

INDUCTION HEATING SYSTEM FOR REHEATING THE EDGES OF A METALLURGICAL PRODUCT AND VARIABLE AIR GAP INDUCTOR ASSOCIATED THEREWITH

FIELD OF THE INVENTION

This invention concerns the inductive reheating of the verges of a metallurgical product, and in particular the verges of rough-rolled slabs of a flat product on a strip mill stand.

BACKGROUND OF THE INVENTION

On leaving the breakdown stand and prior to entering the finishing stand, the slab pauses approximately 1 to 1½ minute on a waiting table. Its dimensions at this stage are commonly 30 to 50 mm thick by 1 to 2 m wide by up to 70 m long.

In addition to a considerable overall cooling (of the order of 100° C.), there occurs a more pronounced cooling of the slab verges due to their greater heat exchange surface area (fin effect).

Experience shows that the zone affected by this localized cooling can extend more than 70 mm inwards of an edge and that the mean temperature differential through the thickness can be as high as 75° C. over this distance, the mean temperature remaining roughly constant beyond the 70 mm verge, as far as 70 mm from the opposite edge of the slab.

Such localized cooling involves three major disadvantages, as follows:

maintaining a minimum temperature throughout the strip at the finishing stand (rolling mill output temperature) requires superheating the slab in the reheating furnace;

a nonuniform thermal profile at the end of rolling leads to nonuniform metallurgical properties over the width of the strip;

and the cold verges bring about greater wearing of the rolls of the finishing stand (tapering)—a phenomenon entailing production engineering constraints on strip production. This is one factor limiting the greater development of hot charging.

Similar problems arise in heavy plate rolling.

The verge temperature gradient could be reduced by installing a tunnel over the waiting table, so as to slow the cooling of the slab as a whole. Moreover, the thermal gradient at the verges could be more substantially reduced by adding burners to preferentially heat the edges. However, such flame heating does not provide the heat output profile needed to solve the problem at hand.

One method proposed in the prior art to cancel the verge differentials is to induction reheat portions of the products using inductors with a U-shaped magnetic core, placed above and below the slab verges: the product advances through the air gap formed between two superposed inductors whose magnetic poles of opposite polarity face one another.

There are also prior art means for related applications consisting of inductors with C-shaped magnetic cores through the opening whereof the product to be heated (strip verges, wires or bars) is made to pass, the ends of the core facing each other and advantageously serving as carriers for the windings of the electrical excitation current conductor, such as to constitute opposite-polarity, wire wound magnetic poles: FR-A-No. 2 489 645 (EDF), FR-A-No. 2 555 353 (CEM) and EP-A-No. 0 170 556 (EDF).

The object of the invention is to provide a new induction "reheating" system having a greater efficiency than the prior art device.

BRIEF SUMMARY OF THE INVENTION

Accordingly, the inventive system comprises inductors with C-shaped magnetic yokes set up along the edges of the slab to straddle the edges thereof, the ends of each yoke facing each other and each serving as a coil core so as to form opposite polarity magnetic field coils, said yokes being formed, for purposes of varying the air gap, of two legs, namely an upper leg and a lower leg, joined by a hinge swivelling about a horizontal axis, each leg being made of a laminate having, at least at the level of the hinge, such as to form flanges thereon, two side cheeks accommodating two trunnions which do not traverse the laminate, with a semicyclindrical clearance being provided between the laminates of the two legs.

It is known that the air gap, which roughly corresponds to the distance covered by the magnetic field "outside" the yoke, assuming that the former follows the preferred path imposed by the yoke, is the most fundamental factor in the inductor's electrical efficiency. That is why one seeks to minimize this parameter.

Thus, if one assumes identical mechanical constraints for the prior art reheating device and the device according to the invention, ie. a same spacing between the slab and the magnetic pole and an identical heat insulation of the poles, it is clear that the air gap between the two sets of poles of the U-shaped inductor is twice as large as the air gap between the two poles of the C-shaped inductor according to the invention. The latter is therefore more efficient. By way of example, efficiencies have been determined experimentally for both devices, under identical conditions (40 mm-thick slab, 15 mm of thermal insulation and product-to-insulation spacing of 15 mm): the efficiency of the C-shaped inductor was found to be 60% and that of the U-shaped inductor about 50%.

Moreover, the induction in the U-shaped inductors is distributed between the set of poles. For any given number of ampere turns, the induction is therefore less concentrated and the profile of induced power more diffuse with the U-shaped inductors than with the C-shaped inductors.

Thanks to the possibility they afford of varying their air gap, the inductors according to the invention can be readily adapted to the conformations assumed by the moving metal strip the verges whereof are to be reheated and be removed more quickly and easily from the process path before passage of the generally curved or upturned head or tail of the strip, merely by backwardly swivelling the upper leg of the yoke.

To this end, means are provided for controlling the amount of opening of the legs, such as a cylinder controlled by a set of metallurgical product presence and position sensors. In addition, the very conceptual design of the hinge according to the invention promotes high electrical efficiency for the inductor, whilst at the same time affording the advantages of a simple technology, there being no hinge pin running through the laminations of the yoke (which otherwise would have to be cooled). It also may be pointed out that the small, semicylindrical working clearance provided between the legs, at the hinge, plays a dual role: it avoids artificially creating additional air gaps in the yoke and guides the magnetic flux lines through the yoke in spite of the deformations of the latter's geometry attendant to swivelling.

BRIEF DESCRIPTION OF THE DRAWINGS

Other features and advantages of the invention will be more readily apparent in reading the detailed description hereinafter, with reference to the appended drawings in which:

FIG. 3 is a schematic side view of an actuator for adjusting the opening or air gap of the hinged, C-shaped inductor;

FIG. 4 is a cross sectional view of the inductor, taken along line IV—IV of FIG. 3; and FIGS. 5A and 5B are schematic views showing two steps in the setting up of the hinged, C-shaped inductors in a strip mill.

DETAILED DESCRIPTION OF THE PREFERRED EMBODIMENTS

Figure 1:
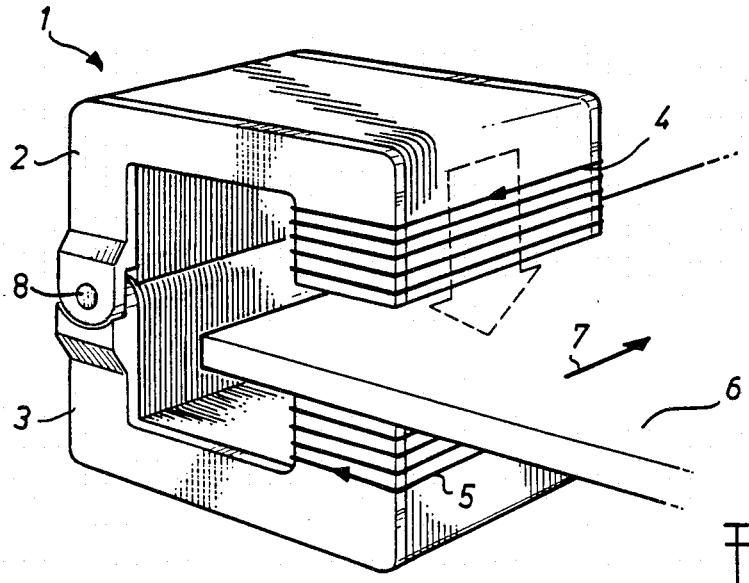
FIG. 1 is a schematic view in perspective of a preferred embodiment of the hinged, C-shaped inductor according to the invention.

The inductor 1 consists of a yoke 2, 3 (or core) of laminated, ferromagnetic sheet metal, shaped as a "C", the ends whereof, which are also the magnetic poles thereof, are facing and serve as the cores for the electrical windings 4 and 5 disposed across from one another, wound the same way and supplied with alternating current at a frequency of several hundred Hertz. A steel strip product 6 advances in the direction of arrow 7 through the air gap (space separating the two poles of the "C") of inductor 1. The verges of strip 6 are reheated by the eddy currents developed therein. A heat shield 23, such as a shield of refractory material, is preferably included (FIG. 3) to protect the magnetic poles from the radiant heat of the steel strip 6.

The magnetic yoke consists of two legs 2 and 3 articulated about an axis 8, located substantially midway up the back of the "C". As appears most clearly in FIG. 4, the laminates 2*a* and 3*a* of the upper and lower legs 2 and 3 respectively of the "C" are clamped between add-on cheeks 2*b* and 3*b* in which the hinge is provided: two trunnions 8*a*, 8*b*, which do not traverse the laminate but are aligned with the axis 8 to each side of the laminated, are shrink-fitted into the cheeks 2*b* to form a yoke straddling the cheeks 3*b* of the lower leg 3 at the level of the joint. Said trunnions 8*a*, 8*b* carry ball bearings 9 the outer race whereof is shrink fitted into the cheeks 3*b* of the lower leg 3.

In the embodiment illustrated in the figures, the cheek plates cover the entire sides of the yoke. This is not an essential feature. What is required is that the cheeks be provided at least at the location of the joint.

Figure 2:
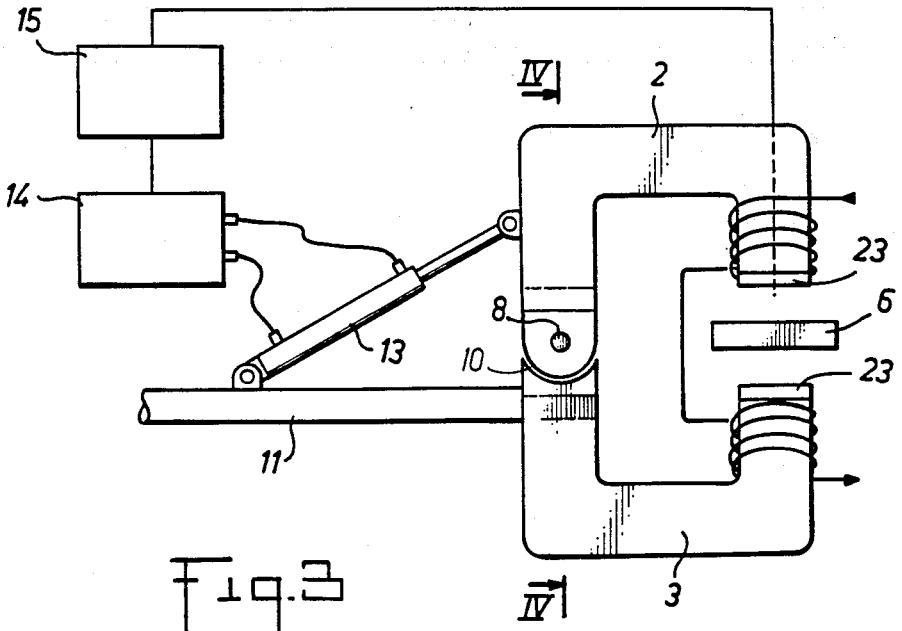
FIG. 2 is a perspective view showing the layout of hinged, C-shaped inductors in an installation for reheating the verges of rough-rolled steel strips.
Figure 2:
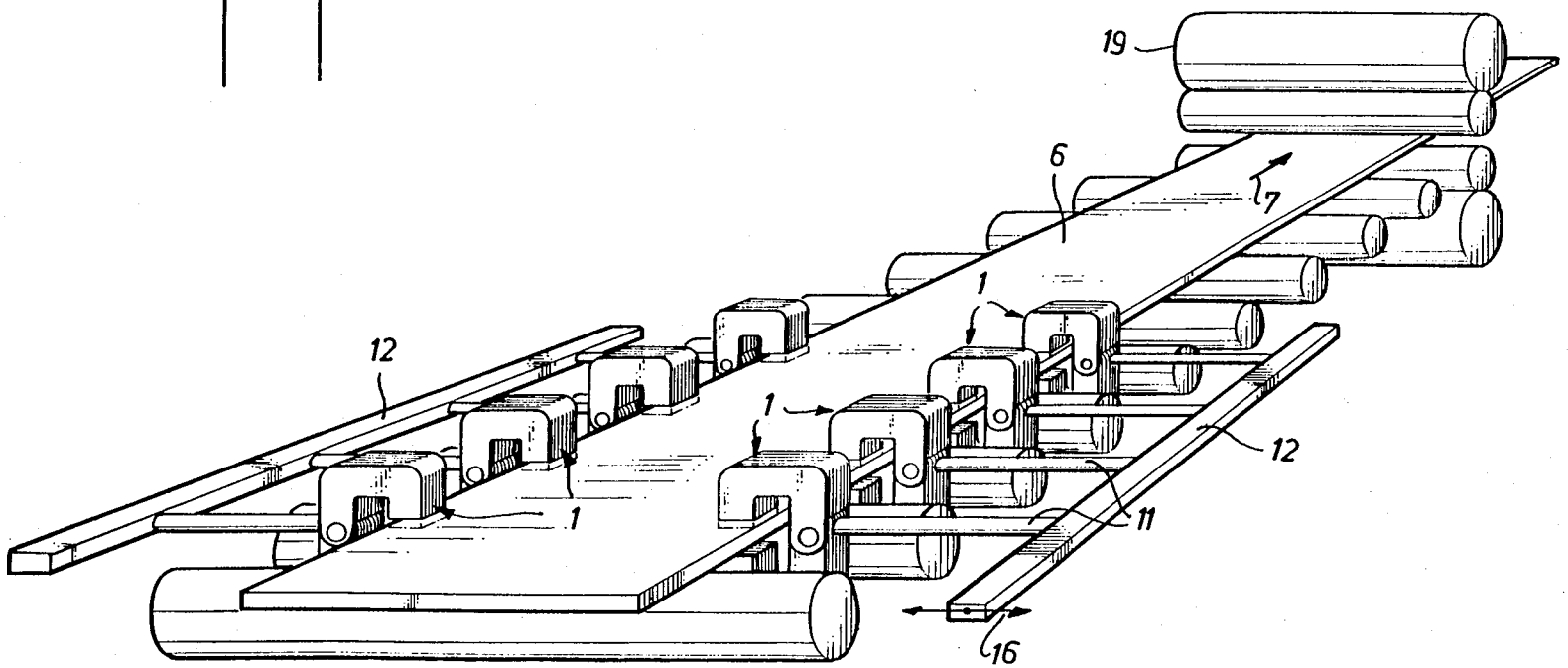

The laminates 2*a*, 3*a* are conformed into cylindrical portions having an axis 8 at their hinged ends, such as to leave between them only a slight working clearance 10 of approximately 1 mm entailing the least possible amount of magnetic flux leakage regardless of the geometric configuration of the inductor. The lower leg 3 is supported by an arm 11 that is itself connected to a longitudinal rail 12 common to a row of inductors (see FIG. 2), installed for example upstream from a finishing stand 19. A double-acting cylinder 13, articulated at one end on the arm 11 and at the other end on the upper leg 2 of the inductor has its pressure chambers connected to an actuator 14 controlled by a set of metallurgical product 6 position sensors 15. Said sensors 15 also control the lateral movement of the rails 12 in the direction of either of the arrows 16 (FIG. 2), by means of additional cylinders not shown in the drawing.

It is possible, through the combination of lateral guiding motions and vertical swivelling motions of the C-shaped inductors, to deal with both the problems of engaging or disengaging the steel strip 6 and those related to variations of the strip's position within the air gap during the rolling process.

FIGS. 5A and 5B show the steps followed in setting up the inductors. Said inductors 1 are first in withdrawn and opened position leaving entirely free passage of the strip 6, and especially of the head of the strip which may be curved upwardly and therefore not normally pass within the air gap of the inductors in working position. When the strip steel product 6 is on line, the cylinders controling the movement of the longitudinal rails 12 are actuated to draw in the inductors 1 in the direction of the arrows 17 (FIG. 5A) toward the product 6.

In process, any lateral deviations as may occur in the product 6 can be allowed for by a suitable lateral displacement of the inductors 1.

At the end of the process, when the up-turned tail end of the product might damage the inductors 1, the upper legs are swivelled away from the product by means of the cylinders 13.

The lateral guiding of the inductors also enables the reheating system to be adapted to different widths of metallurgical products.

However, unlike the hinging of the yoke, this lateral guidance of the inductors represents an embodiment which, though certainly advantageous, is by no means mandatory and is not required if for instance the same product or type of product is always to be run through the air gap and its travel is well controlled. Likewise, the articulation point in the back of the "C" can obviously be located elsewhere than at its center without departing from the scope of the invention.

What is claimed is:

1. A device for the inductive reheating of the verges of a metallurgical product moving down a production line, of the type comprising inductors with C-shaped magnetic yokes set up laterally along the path followed by the verges and straddling said verges, the ends of each yoke facing one another and forming wound magnetic poles of opposite polarity, said device wherein said yokes are formed, for purpose of varying the air gap, or spacing between said poles, of two legs, joined by a hinge swivelable about an axis, each leg being made of a laminate having, at least at the level of the hinge, forming flanges thereon and two side cheeks accommodating two trunnions which do not traverse the laminate, and wherein a semicylindrical clearance is provided between the laminates of the two legs.

2. A device for the inductive reheating of the verges of a metallurgical product as in claim 1, provided with a control means, for adjusting the opening of said hinged legs, which control means is itself controlled by product position sensing means.

3. A device as in claim 2, wherein said control means is a double acting cylinder.

4. A device as in claim 3, wherein said control means act on the upper leg of said inductor yokes.

5. A device as in claim 2, wherein said inductors are provided with lateral guiding means.

6. An inductor for use in a device for the inductive reheating of the verges of a metallurgical product moving down a production line, having a C-shaped magnetic yoke with facing coil-wound poles, wherein said yoke consists of two legs joined by a hinge rotating about an axis, each leg consisting of a laminate of ferromagnetic sheets sandwiched between side cheeks accommodating two trunnions, one in each side of the laminates, aligned with said hinge axis, wherein a semi-cylindrical working clearance is provided between the two legs and wherein control means are provided to adjust the opening of the legs.

7. An inductor according to claim 6, wherein said control means include a double-acting cylinder.

8. Inductor as in claims 6, wherein said control means act upon the upper leg of the yoke.

9. Inductor as in claims 6, the poles whereof are provided with a heat shield.

* * * * *